US010017991B2

(12) United States Patent
von Gynz-Rekowski et al.

(10) Patent No.: US 10,017,991 B2
(45) Date of Patent: Jul. 10, 2018

(54) HAMMER DRILL

(71) Applicant: ASHMIN HOLDING LLC, Conroe, TX (US)

(72) Inventors: Gunther H H von Gynz-Rekowski, Montgomery, TX (US); Michael V. Williams, Montgomery, TX (US); Russell Koenig, Conroe, TX (US)

(73) Assignee: Ashmin Holding LLC, Conroe, TX (US)

( * ) Notice: Subject to any disclaimer, the term of this patent is extended or adjusted under 35 U.S.C. 154(b) by 277 days.

(21) Appl. No.: 14/864,405

(22) Filed: Sep. 24, 2015

(65) Prior Publication Data

US 2016/0108674 A1 Apr. 21, 2016

Related U.S. Application Data

(60) Provisional application No. 62/065,532, filed on Oct. 17, 2014.

(51) Int. Cl.

| | |
|---|---|
| ***E21B 6/02*** | (2006.01) |
| ***E21B 1/00*** | (2006.01) |
| ***E21B 3/00*** | (2006.01) |
| ***E21B 17/07*** | (2006.01) |
| ***E21B 4/06*** | (2006.01) |
| ***E21B 4/10*** | (2006.01) |

(52) U.S. Cl.

CPC ..... *E21B 1/00* (2013.01); *E21B 3/00* (2013.01); *E21B 4/06* (2013.01); *E21B 4/10* (2013.01); *E21B 6/02* (2013.01); *E21B 17/07* (2013.01)

(58) Field of Classification Search

CPC ..... E21B 1/00; E21B 3/00; E21B 4/06; E21B 4/10; E21B 6/02; E21B 17/07

USPC ..... 175/57

See application file for complete search history.

(56) References Cited

U.S. PATENT DOCUMENTS

| | | | | |
|---|---|---|---|---|
| 2,613,917 | A * | 10/1952 | Postlewaite | E21B 4/10 175/106 |
| 3,538,498 | A | 11/1970 | Dorm | |
| 3,807,512 | A | 4/1974 | Pogonowski et al. | |
| 8,226,299 | B2 | 7/2012 | Hubbard et al. | |
| 2004/0089461 | A1 | 5/2004 | Cioceanu | |

(Continued)

FOREIGN PATENT DOCUMENTS

| | | | |
|---|---|---|---|
| EP | 0432786 B1 * | 6/1995 | F16H 25/125 |
| WO | 2013148521 | 10/2013 | |
| WO | 2014089457 | 6/2014 | |

OTHER PUBLICATIONS

International Search Report issued in corresponding International Patent Application No. PCT/US15/53548.

(Continued)

*Primary Examiner* — Taras P Bemko

(74) *Attorney, Agent, or Firm* — Jones Walker LLP

(57) ABSTRACT

A downhole apparatus connected to a workstring within a wellbore. The workstring is connected to a bit member. The apparatus includes a mandrel operatively connected to a downhole motor mechanism, an anvil member operatively formed on the bit member, the anvil member being operatively connected to the mandrel, a radial bearing housing unit operatively connected to the workstring, with the radial bearing housing unit being disposed about the mandrel, and a hammer member slidably attached to the radial bearing housing unit.

12 Claims, 11 Drawing Sheets

(56) References Cited

U.S. PATENT DOCUMENTS

| | | | |
|---|---|---|---|
| 2011/0031020 | A1 | 2/2011 | Cote |
| 2015/0107904 | A1 | 4/2015 | Kerstetter |

OTHER PUBLICATIONS

Written Opinion issued in corresponding International Patent Application No. PCT/US15/53548.
Extended European Search Report dated May 11, 2018, in Applicant's counterpart European Patent Application No. 15850020.7.

* cited by examiner

HAMMER DRILL

CROSS-REFERENCE TO RELATED APPLICATIONS

This application claims the benefit of and priority to U.S. Provisional Patent Application No. 62/065,532, filed on Oct. 17, 2014, which is incorporated herein by reference.

BACKGROUND OF THE INVENTION

This invention relates to downhole tools. More particularly, but not by way of limitation, this invention relates to a downhole percussion tool.

In the drilling of oil and gas wells, a bit means is utilized to drill a wellbore. Downhole percussion tools, sometimes referred to as hammers, thrusters, or impactors are employed in order to enhance the rate of penetration in the drilling of various types of subterranean formations. In some types of wellbores, such as deviated and horizontal wells, drillers may utilize downhole mud motors. The complexity and sensitivity of bottom hole assemblies affects the ability of drillers to use certain tools, such as downhole hammers.

SUMMARY OF THE INVENTION

In one embodiment, a downhole apparatus connected to a workstring within a wellbore is disclosed. The workstring is connected to a bit member. The apparatus comprises a power mandrel operatively connected to a motor means; an anvil member operatively formed on the bit member, the anvil member being operatively connected to the power mandrel; a radial bearing housing unit operatively connected to the workstring, with the radial bearing housing unit being disposed about the power mandrel; a spring saddle operatively attached to the radial bearing housing unit; a spring spacer disposed about the spring saddle; a spring having a first end and a second end, with the first end abutting the spring saddle; a hammer member slidably attached to the spring saddle, and wherein the hammer member abuts the second end of the spring. In one preferred embodiment, the hammer and the anvil is below the radial bearing housing unit. The workstring may be a tubular drill string, or coiled tubing or snubbing pipe. The anvil member contains a radial cam face having an inclined portion and a upstanding portion. The hammer member contains a radial cam face having an inclined portion and a upstanding portion.

In another embodiment, a downhole apparatus is connected to a workstring within a wellbore, with the downhole apparatus connected to a bit member. The apparatus comprises a mandrel operatively connected to a motor means; an anvil operatively formed on the bit member, with the anvil being operatively connected to the mandrel; a radial bearing housing unit operatively connected to the workstring, with the radial bearing housing unit being disposed about the mandrel; and a hammer slidably attached to the radial bearing housing unit. In one embodiment, the hammer and the anvil is below the radial bearing housing unit. The anvil contains a cam face having an inclined portion and an upstanding portion, and the hammer contains a cam face having an inclined portion and a upstanding portion. The apparatus may optionally further include a spring saddle operatively attached to the radial bearing housing unit; and, a spring spacer disposed about the spring saddle, with a spring having a first end and a second end, with the first end abutting the spring spacer. In one embodiment, the hammer is slidably attached to the radial bearing housing unit with spline means operatively positioned on the spring saddle.

Also disclosed in one embodiment, is a method for drilling a wellbore with a workstring. The method includes providing a downhole apparatus connected to the workstring within a wellbore, the apparatus being connected to a bit member, the downhole apparatus comprising: a power mandrel operatively connected to a motor means, thereby providing torque and rotation from the motor to the bit via the power mandrel, an anvil member operatively formed on the bit member, the anvil member being operatively connected to the power mandrel; a radial bearing housing unit operatively connected to the workstring, with the radial bearing housing unit being disposed about the power mandrel; a spring saddle operatively attached to the radial bearing housing unit; a spring spacer disposed about the spring saddle, a spring having a first end and a second end, with the first end abutting the spring-spacer; a hammer member slidably attached to the spring saddle, and wherein the hammer member abuts the second end of the spring. The method further includes lowering the workstring into the wellbore; contacting the bit member with a subterranean interface (such as reservoir rock); engaging a distal end of the power mandrel with an inner surface of the bit member; slidably moving the anvil member; and, engaging a radial cam surface of the anvil member with a reciprocal radial cam surface of the hammer member so that the hammering member imparts a hammering (sometimes referred to as oscillating) force on the anvil member.

In one disclosed embodiment, when activating the motor (pumping fluid), the power mandrel, the drive shaft and the bit box sub are spinning the bit. If the hammermass cam surface and the anvil cam surface are engaged, the hammering (i.e. percussion) is activated and adds an oscillating force to the bitbox sub. Thus, the bit will be loaded with the static weight on bit from the drill string and the added oscillating force of the impacting hammermass. If the hammermass cam surface and the anvil cam surface are disengaged, the bitbox sub is only rotating.

A feature of the disclosure is that the spring means is optional. With regard to the spring embodiment, the type of spring used may be a coiled spring or Belleville spring. An aspect of the spring embodiment includes if the hammermass cam surface and the anvil cam surface are engaged and the hammermass is sliding axially relative to the anvil member, the spring means will be periodically compressed and released thus periodically accelerating the hammermass towards the anvil member that in turn generates an additional impact force. A feature of the spring embodiment is the spring adjusted resistance without moving the mandrel relative to the housing. Another feature of one embodiment is the mandrel is defined by supporting the axial and radial bearings. Another feature of one embodiment is that the hammer mechanism can be located between the bit and the motor or below the bearing section and the motor.

As per the teachings of the present disclosure, yet another feature includes that the motor means turns and hammers (i.e. oscillating force) when drilling fluid is pumped through the motor and both cam faces are engaged. Another feature is the motor only turns when drilling fluid is pumped through the motor and both cam faces are disengaged. The motor does not turn nor hammers when no drilling fluid is pumped.

DETAILED DESCRIPTION OF THE PREFERRED EMBODIMENTS

Figure 1:
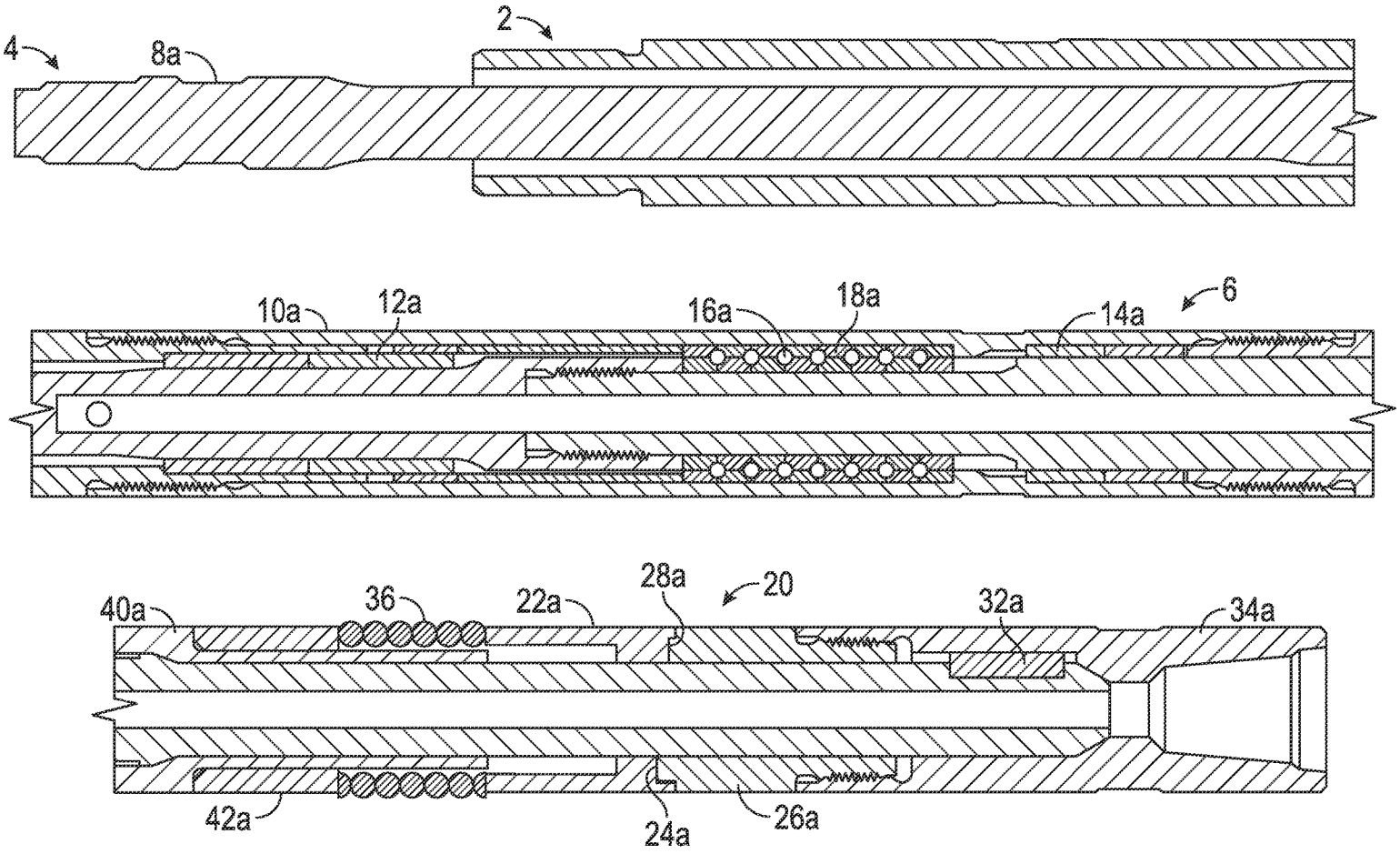
FIG. 1 is a partial sectional view of a first embodiment of the downhole apparatus.

Referring now to the FIG. 1, a partial sectional view of the downhole apparatus 2 of a first embodiment will now be discussed. The first embodiment apparatus 2 includes a power mandrel, seen generally at 4, that is operatively attached to the output of a downhole mud motor (not shown). The apparatus 2 also includes a radial bearing housing unit, seen generally at 6. The radial bearing housing unit 6 will be operatively attached to the workstring, such as drill pipe or coiled tubing, as will be described later in this disclosure. More particularly, FIG. 1 shows the power mandrel 4 (which is connected to the output of the motor section, as is well understood by those of ordinary skill in the art). The mandrel 4 may be referred to as the power mandrel or flex shaft. Also shown in FIG. 1 is the upper bearing housing 10*a* which includes the upper radial bearings 12*a*, lower radial bearing 14*a*, balls 16*a* and thrust races 18*a*. The lower housing is seen generally at 20*a* in FIG. 1 and will be described in further detail.

As seen in FIG. 1, a partial sectional view of lower housing 20*a* of the downhole apparatus 2 of the first embodiment is shown. FIG. 1 depicts the hammermass 22*a* (sometimes referred to as the hammer member or hammer), which is attached (for instance, by spline means via a spring saddle 40*a*) to the radial bearing housing unit 6. The hammermass 22*a* will have a radial cam surface 24*a*. The hammermass 22*a* will engage with the anvil 26*a*, wherein the anvil 26*a* has a first end that contains a radial cam surface 28*a*, wherein the radial cam surface 28*a* and radial cam surface 24*a* are reciprocal and cooperating in the preferred embodiment, as more fully set out below. FIG. 1 also depicts the power mandrel 4, which is fixed connected to the driveshaft 30*a* via thread connection or similar means. A key 32*a* (also referred to as a spline) allows for rotational engagement of the power mandrel 4 and the driveshaft 30*a* with the bitbox sub 34*a*, while also allowing for lateral movement of the bitbox sub 34 relative to the drive shaft 30*a*. The anvil 26*a* is fixedly connected to the bitbox sub 34*a*.

FIG. 1 also depicts the spring means 36 for biasing the hammermass 22*a*. The spring means 36 is for instantaneous action. More specifically, FIG. 1 depicts the spring saddle 40*a* that is an extension of the bearing housing 6 i.e. the spring saddle 40*a* is attached (via threads for instance) to the bearing housing 6. The spring saddle 40*a* is disposed about the driveshaft 30*a*. Disposed about the spring saddle 40*a* is the spacer sub 42*a*, wherein the spacer sub 42*a* can be made at a variable length depending on the amount of force desired to load the spring means 36. As shown, the spring means 36 is a coiled spring member. The spring means 36 may also be a Belleville washer spring. One end of the spring means 36 abuts and acts against the hammermass 22*a* which in turn urges to engagement with the anvil 26*a*.

Figure 2:
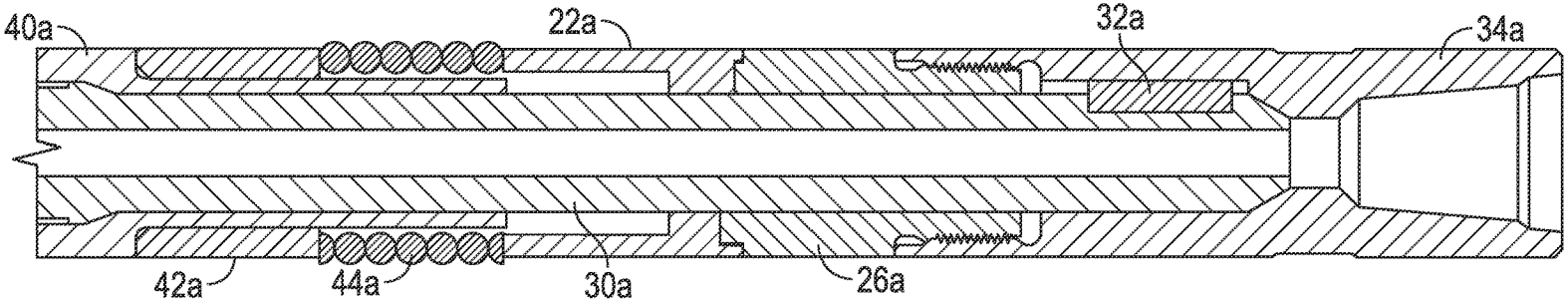
FIG. 2 is a partial sectional view of lower housing of the downhole apparatus of the first embodiment in the engaged mode.
Figure 3:
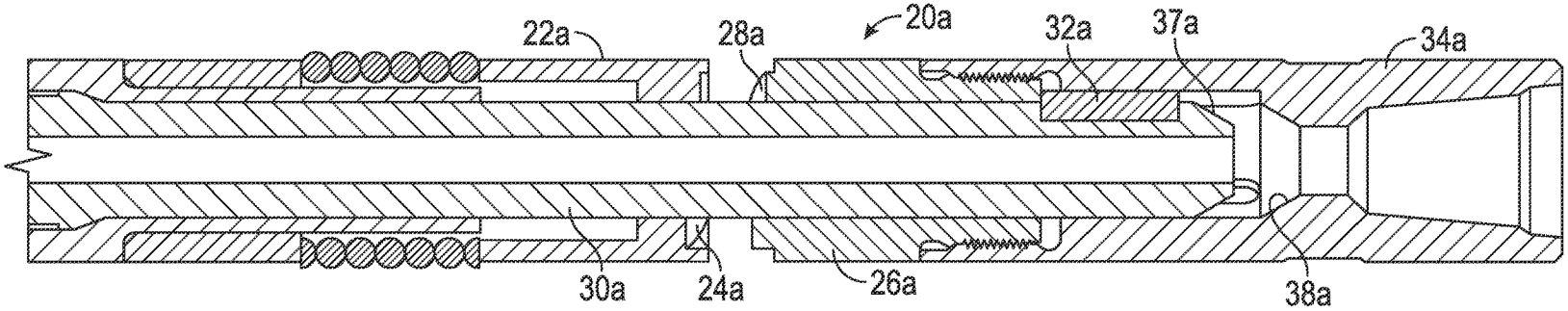
FIG. 3 is a partial sectional view of the lower housing of the downhole apparatus of the first embodiment in the disengaged mode.

In FIG. 2, a partial sectional view of the lower housing 20*a* of the downhole apparatus 2 of the first embodiment in the engaged mode is shown. It should be noted that like numbers appearing in the various figures refer to like components. The cam surface 24*a* and cam surface 28*a* are abutting and are face-to-face. Note the engaged position of the end 37*a* of the driveshaft 30*a* with the angled inner surface 38*a* of the bitbox sub 34*a* securing the axial transmission of the WOB from the drillstring to the bitbox sub 34*a* and the bit (not showing here). In FIG. 3, a partial sectional view of the lower housing 20*a* of the downhole apparatus 2 of the first embodiment in the disengaged mode will now be described. In this mode, the apparatus 2 can be, for instance, running into the hole or pulling out of the hole, as is well understood by those of ordinary skill in the art. Therefore, the radial cam surface 24*a* of hammer 22*a* is no longer engaging the radial cam surface 28*a* of the anvil 26*a*. Note the position of the end 37*a* of the driveshaft 30*a* in relation to the angled inner surface 38*a* of the bitbox sub 34*a*. As stated previously, the bit member (not shown in this view) is connected by ordinary means (such as by thread means) to the bitbox sub 34*a*.

Figure 4:
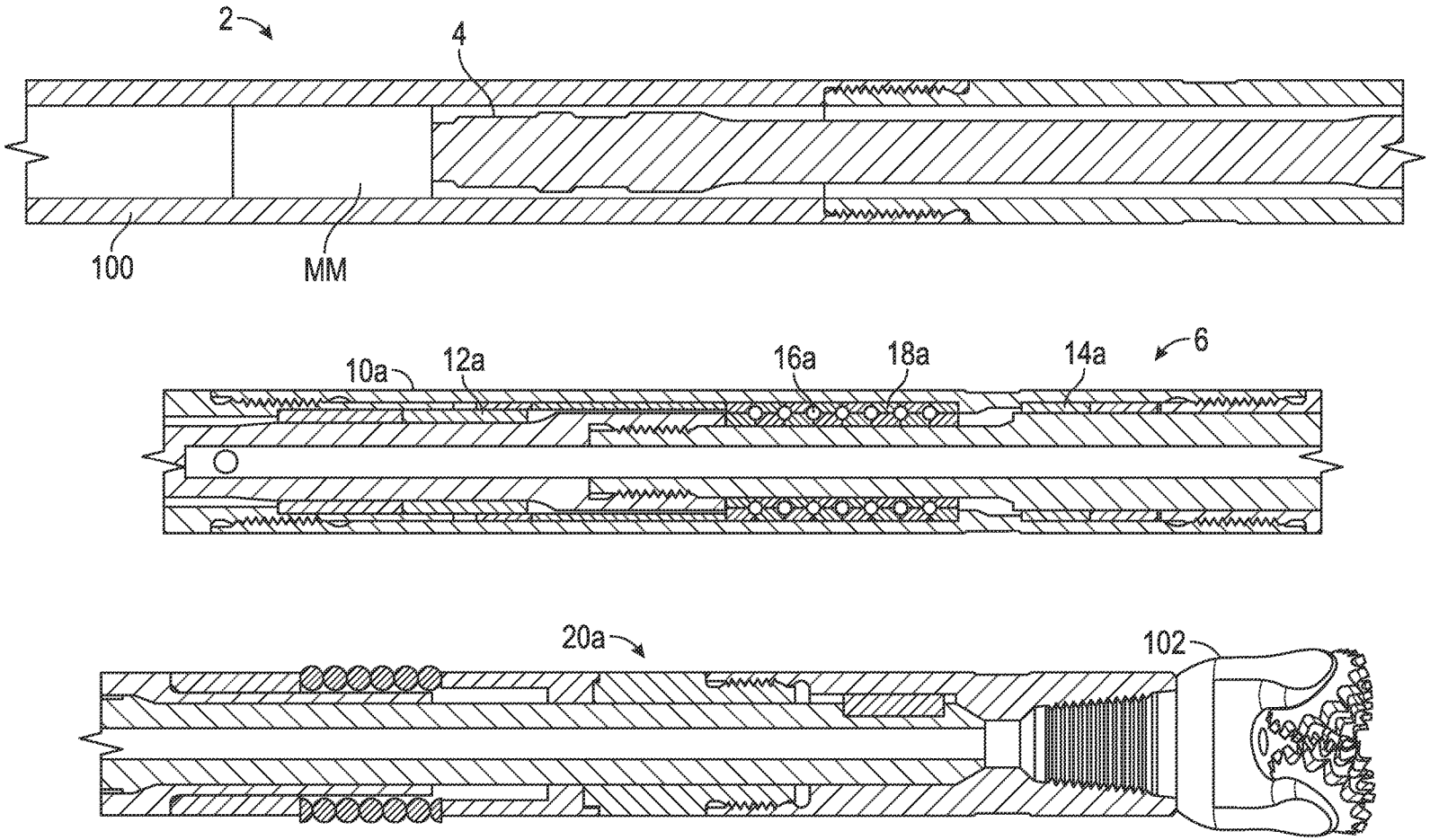
FIG. 4 is a partial sectional view of the downhole apparatus of the first embodiment as part of a bottom hole assembly.

Referring now to the FIG. 4, a schematic view of the downhole apparatus 2 of the first embodiment will now be discussed as part of a bottom hole assembly. The first embodiment the apparatus 2 includes the power mandrel, seen generally at 4, that is operatively attached to the output of a downhole mud motor "MM". The apparatus 2 also includes a radial bearing housing unit, seen generally at 6. The radial bearing housing unit 6 will be operatively attached to the workstring 100, such as drill pipe or coiled tubing. Also shown in FIG. 4 is the upper bearing housing 10*a* which includes the upper radial bearings 12*a*, lower radial bearing 14*a*, balls 16*a* and thrust races 18*a*. The lower housing is seen generally at 20*a*. As shown in FIG. 4, the bit 102 is attached to the apparatus 2, wherein the bit 102 will drill the wellbore as readily understood by those of ordinary skill in the art.

Figure 5:
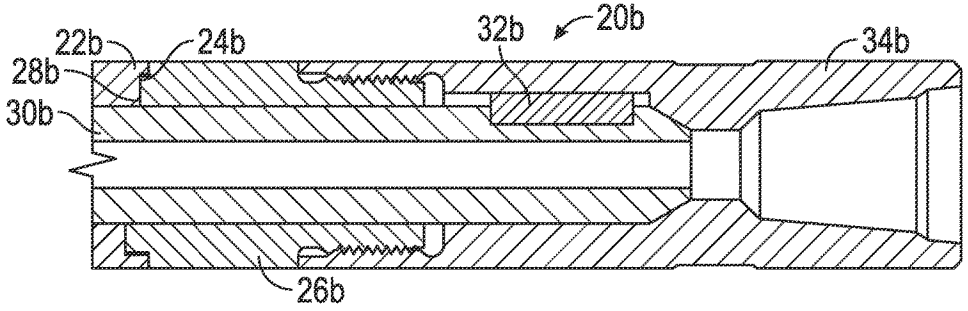
FIG. 5 is a partial sectional view of lower housing of the downhole apparatus of a second embodiment in the engaged mode.
Figure 6:
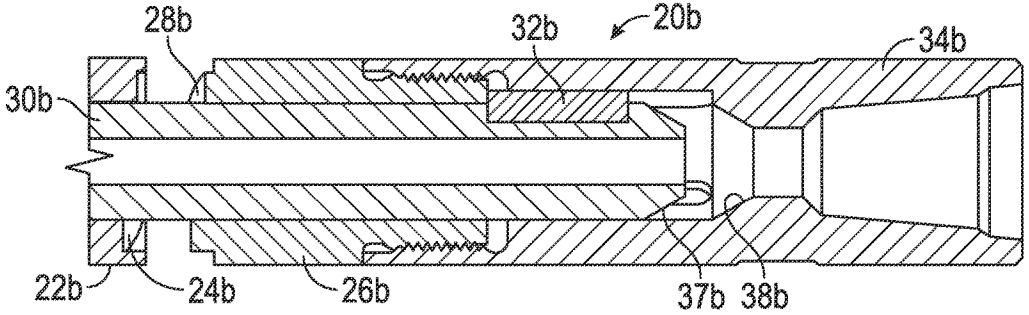
FIG. 6 is a partial sectional view of the lower housing of the downhole apparatus of the second embodiment in the disengaged mode.

FIG. 5 and FIG. 6 depict the embodiment of the apparatus 2 without the spring means. Referring now to FIG. 5, a partial sectional view of lower housing 20*b* of the downhole apparatus 2 of a second embodiment in the engaged mode is shown. FIG. 5 depicts the hammermass 22*b* (sometimes referred to as the hammer member or hammer), which is attached (for instance, by spline means) to the spring saddle and the radial bearing housing unit (not shown here). The hammermass 22*b* will have a radial cam surface 24*b*. The hammermass 22*b* will engage with the anvil 26*b*, wherein the anvil 26*b* has a first end that contains a radial cam surface 28*b*, wherein the radial cam surface 28*b* and radial cam surface 24*b* of the hammermass 22*b* are reciprocal and cooperating in the preferred embodiment, as more fully set out below. FIG. 5 also depicts the driveshaft 30*b* (with the driveshaft 30*b* being connected to the power mandrel, not shown here). A key 32*b* (also referred to as a spline) allows for rotational engagement of the drive shaft 30*b* with the bitbox sub 34*b*, while also allowing for lateral movement of the bitbox sub 34*b* relatively to the driveshaft 30*b*-. The anvil 26*b* is fixed connected to the bitbox sub 34*b*.

In FIG. 6, a partial sectional view of the lower housing 20*b* of the downhole apparatus 2 of the second embodiment in the disengaged mode will now be described. In this mode, the apparatus 2 can be, for instance, running into the hole or pulling out of the hole, as well understood by those of ordinary skill in the art. Hence, the radial cam surface 24*b* of hammermass 22*b* is no longer engaging the radial cam surface 28*b* of the anvil 26*b*. Note the position of the end 37*b* of the driveshaft 30*b* in relation to the angled inner surface 38*b* of the bitbox sub 34*b*. As previously mentioned, a bit member is connected (such as by thread means) to the bitbox sub 34*b*.

Figure 7A:
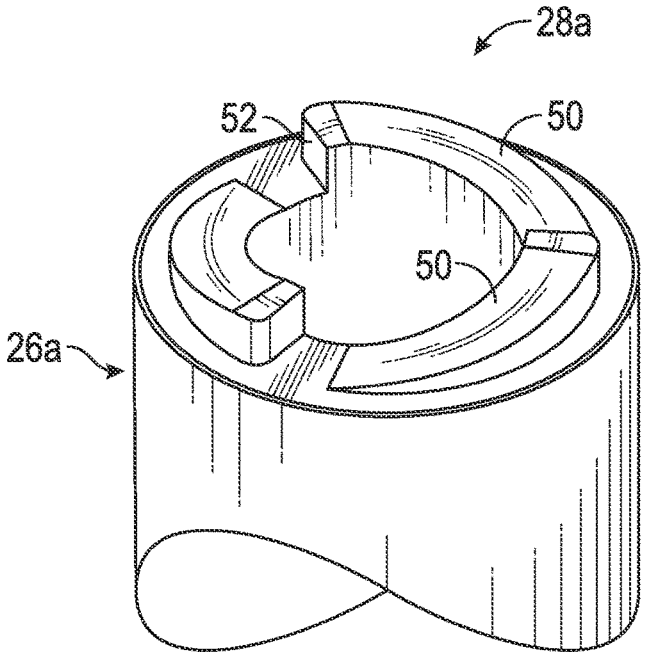
FIG. 7A is perspective view of one embodiment of the anvil radial cam member.
Figure 7B:
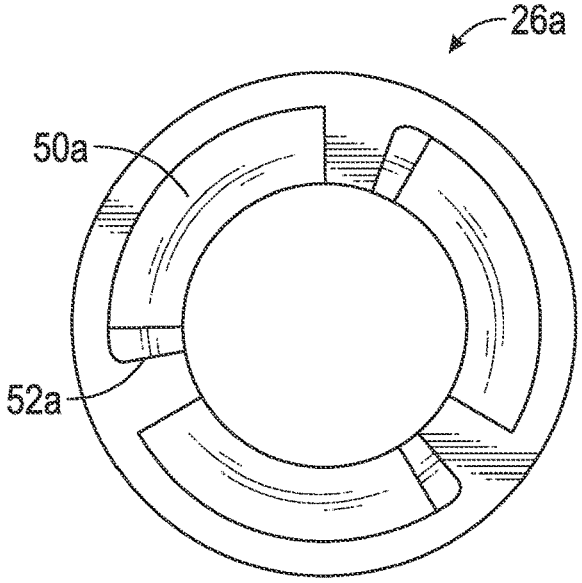
FIG. 7B is a top view of the anvil radial cam member seen in FIG. 7A.

Referring now to FIG. 7A, a perspective view of one embodiment of the anvil radial cam member. More specifically, FIG. 7A depicts the anvil 26*a* having the radial cam surface 28*a*, wherein the radial cam surface 28*a* includes an inclined portion 50, horizontal (flat) portion 51, and an upstanding portion 52. The inclined portion 50 may be referred to as a ramp that leads to the vertical upstanding portion 52 as seen in FIG. 7A. FIG. 7B is a top view of the anvil radial cam member seen in FIG. 7A. In one embodiment, multiple ramps (such as inclined portion 50, horizontal portion 51, extending to an upstanding portion 52) can be provided on the radial cam surface 26*a*.

Figure 8:
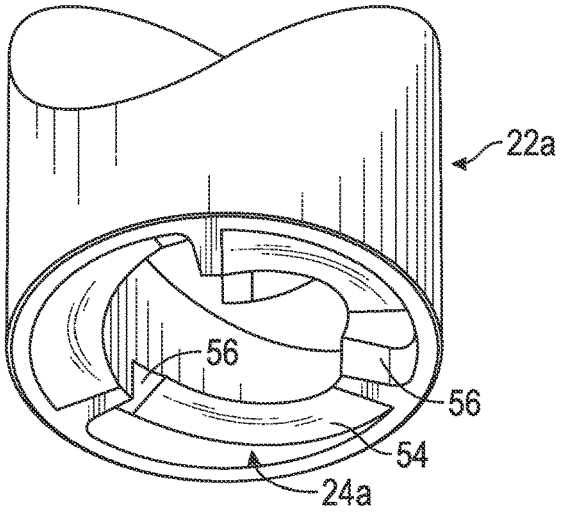
FIG. 8 is a perspective view of one embodiment of the hammer radial cam member.

In FIG. 8, a perspective view of one embodiment of the hammer radial cam member is depicted. More specifically, FIG. 8 shows the hammermass 22*a* that has a radial cam surface 24*a*. The radial cam surface 24*a* also has an inclined portion 54, horizontal (flat) portion 55 and an upstanding portion 56, which are reciprocal and cooperating with the inclined portion and upstanding portion of the anvil radial cam surface 28*a*, as noted earlier. Note that the cam means depicted in FIGS. 7A, 7B and 8 will be the same cam means for the second embodiment of the apparatus 2 illustrated in FIGS. 5 and 6.

Figure 9:
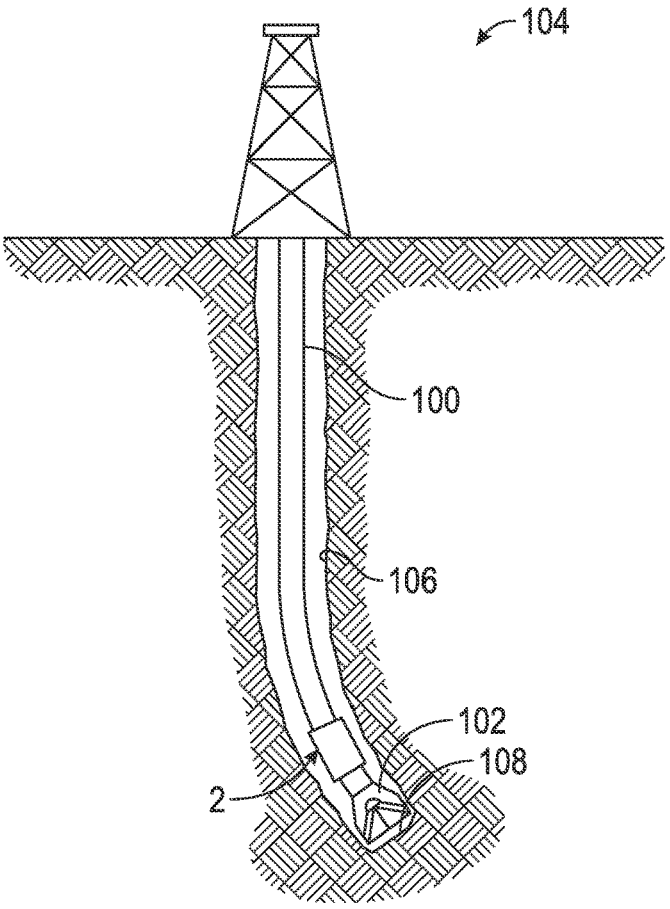
FIG. 9 is a schematic depicting the downhole apparatus of the present invention in a wellbore.

A schematic of a drilling rig 104 with a wellbore extending therefrom is shown in FIG. 9. The downhole apparatus 2 is generally shown attached to a workstring 100, which may be a drill string, coiled tubing, snubbing pipe or other tubular. The bit member 102 has drilled the wellbore 106 as is well understood by those of ordinary skill in the art. The downhole apparatus 2 can be used, as per the teachings of this disclosure, to enhance the drilling rate of penetration by use of a percussion effect with the hammer 22*a*/22*b* impacting force on the anvil 26*a*/26*b*, previously described. In one embodiment, the downhole hammer is activated by the bit member 102 coming into contact with a reservoir interface, such as reservoir rock 108 found in subterranean wellbores or other interfaces, such as bridge plugs. In one embodiment, a driller can drill and hammer at the same time. As per the teachings of this invention, in the spring (first) embodiment, the hammermass will be accelerated by a spring force of the compressed spring thus generating an impact force when the hammermass hits the anvil member.

Figure 10A:
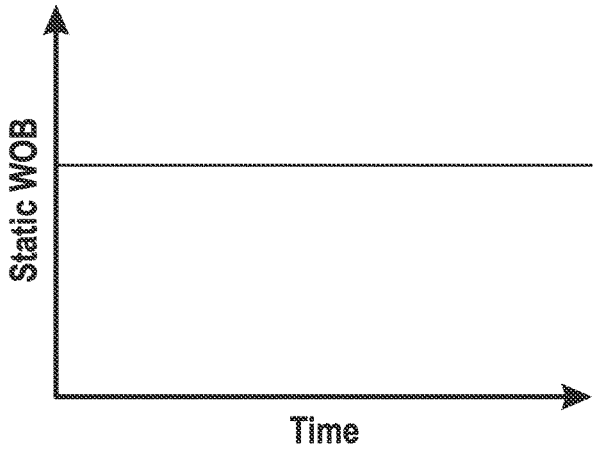
FIG. 10A is a graph of static weight on bit (WOB) versus time during drilling operations.
Figure 10B:
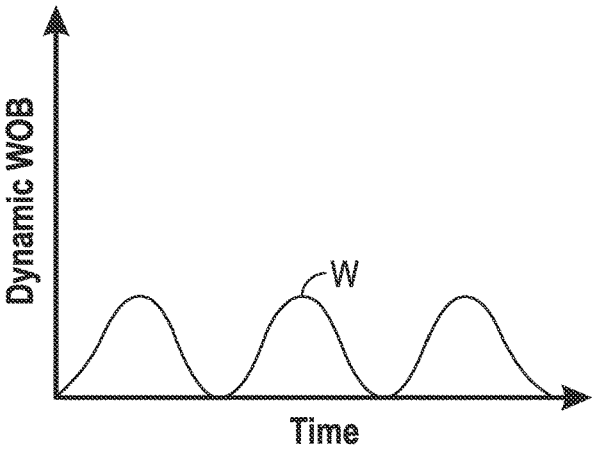
FIG. 10B is a graph of dynamic WOB utilizing a percussion unit.
Figure 10C:
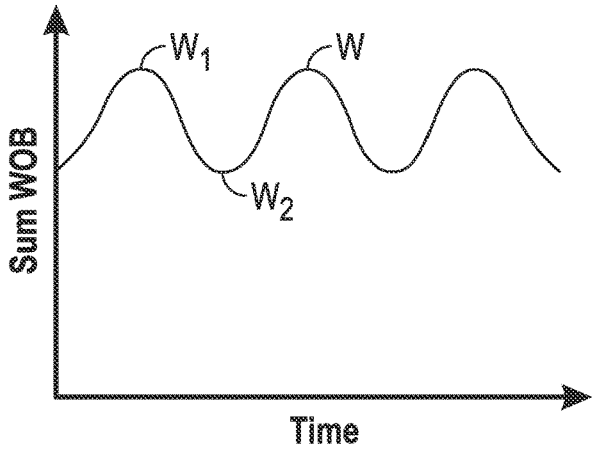
FIG. 10C is a graph of dynamic WOB utilizing percussion unit, wherein the impact force is overlaid relative to the static load.

Referring now to FIGS. 10A, 10B and 10C, graphs of the weight on bit (WOB) versus time during drilling operations will now be discussed. More specifically, FIG. 10A is the static WOB versus time; FIG. 10B is a dynamic WOB utilizing the hammer and anvil members (i.e. percussion unit); and, FIG. 10C represents—the summarized WOB wherein the impact force is graphically overlaid (i.e. summation) relative to the static load, in accordance with the teachings of this disclosure. As noted earlier, the percussion unit is made-up of the anvil, hammer, cam shaft arrangement and spring. The wave form W depicted in FIGS. 10B and 10C represent the oscillating impact force of the percussion unit during use. Note that in FIG. 10C, W1 represents the force when the hammermass impacts the anvil and W2 represents the force when the hammermass does not impact the anvil. It must be noted that the size and shape of the wave form can be diverse depended on the material and the design of the spring, the anvil, the hammermass and the spacer sub.

An aspect of the disclosure is that the static weight of the drill string is transmitted different to the bit than the impact force (dynamic weight on bit) created by the hammer and anvil member. The static WOB is not transmitted through the hammer and anvil members including cam surface (i.e. cam shaft arrangement). The impact force is transmitted through the hammer and anvil to the bit and not through the camshaft arrangement. The percussion unit will generate the impact force if the cam shafts arrangements are engaged independently of the amount of WOB. Yet another aspect of one embodiment of the disclosure is the power section of the motor is simultaneously rotationally driving the bit and axially driving the hammer member. No relative axial movement is taking place between the housing of the apparatus and the inner drive train (including the power mandrel and the driveshaft) that is driving the bit and the percussion unit.

Another aspect of the one embodiment is the anvil is positioned as close as possible to the bit; the bit box and/or bit can function as an anvil. Still yet another aspect of one embodiment is that when the bit does not encounter a resistance, no interaction between the two cams is experienced and thus no percussion motion.

Figure 11:
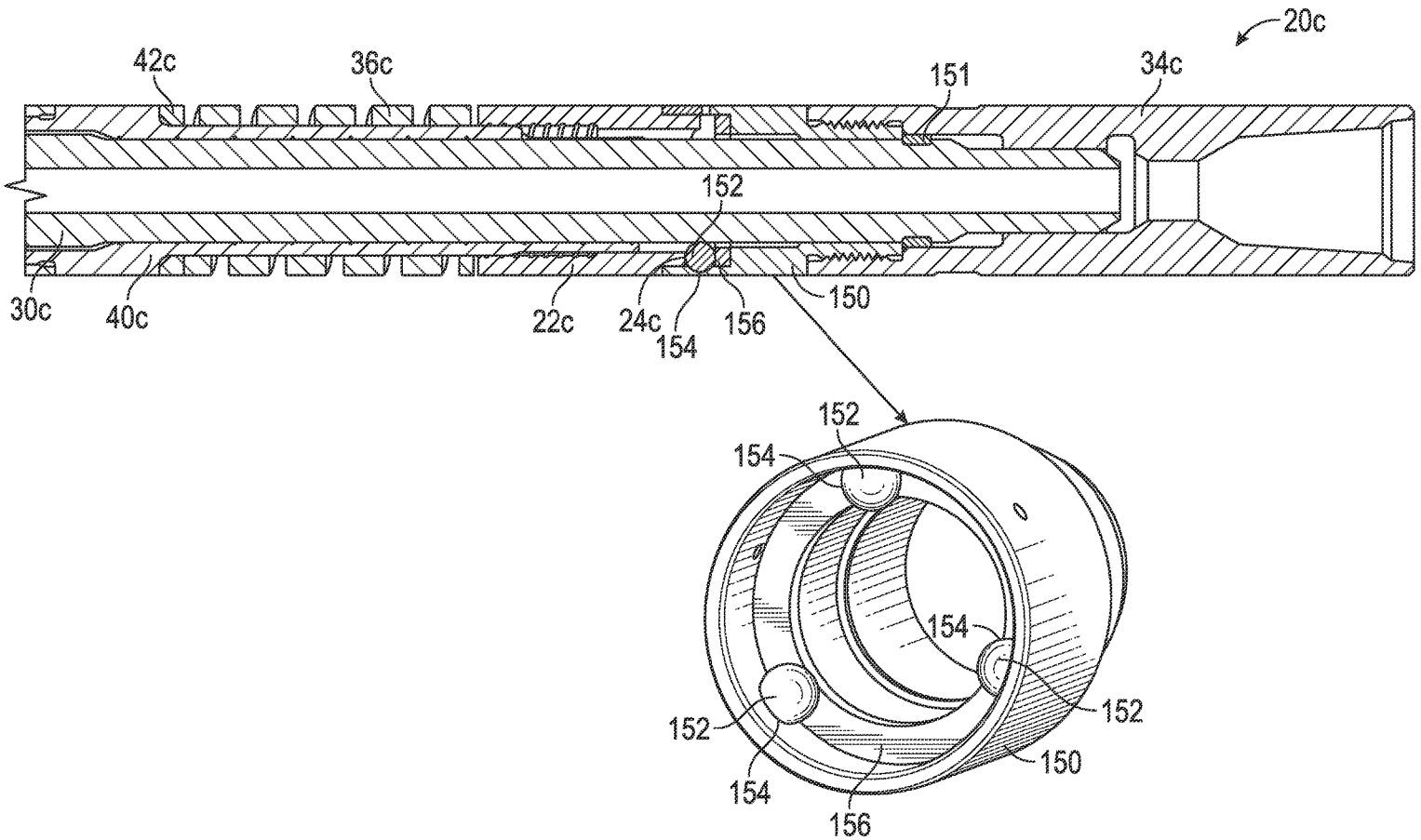
FIG. 11 is a partial sectional view of an alternate embodiment of the lower housing of the downhole apparatus.

FIG. 11 illustrates an alternate embodiment of lower housing 20*c* with spring saddle 40*c* disposed about driveshaft 30*c*. Spring means 36*c* is disposed about spring saddle 40*c*. One end of spring means 36*c* abuts and acts against hammermass 22*c* while the other end of spring means 36*c* abuts and acts against spacer sub 42*c*. Anvil sub 150 is also disposed about driveshaft 30*c*. Anvil sub 150 is fixedly connected to bitbox sub 34*c*. Key 151 may rotationally lock bitbox sub 34*c* to driveshaft 30*c*, while allowing axial movement of bitbox sub 34*c* and anvil sub 150 relative to driveshaft 30*c*. Rolling element 152 may be disposed in partial cavity 154 inside of anvil sub 150. This apparatus may include any number of rolling elements 152. The number of rolling elements, however, should not exceed the number of high points or ramp portions on radial cam surface 24*c*. In one embodiment, the number of rolling elements 152 may be equal to the number of high points or the number or ramp portions on radial cam surface 24*c* (described in more detail below). The rolling elements 152 may be equally spaced along the circumference of the anvil sub 150 and the radial cam surface 24*c*. In another embodiment, partial cavity 154 may be in an inner wall of anvil sub 150. Anvil sub 150 may include three partial cavities 154 each dimensioned to retain rolling elements 152. Anvil sub 150 may include any number of partial cavities 154 for housing rolling elements 152. Partial cavities 154 contain rolling elements 152 while allowing rotation of rolling elements 152 within the cavities. Rolling elements 152 may be spherical members, elongated spherical members, cylindrical members, other convex members, or concave members. In one embodiment, the spherical elements are stainless steel ball bearings or ceramic balls. Wear ring 156 may be disposed within anvil sub 150 adjacent to partial cavities 154 and rolling elements 152. As anvil sub 150 rotates with the rotation of driveshaft 30*c*, rolling elements 152 roll along radial cam surface 24*c* of hammermass 22*c* thereby creating an axial displacement of hammermass 22*c* relative to anvil sub 150 until rolling elements 152 roll over an upstanding portion of radial cam surface 24*c* creating an axial impact as spring 36*c* forces hammermass 22*c* toward anvil sub 150.

Figure 12:
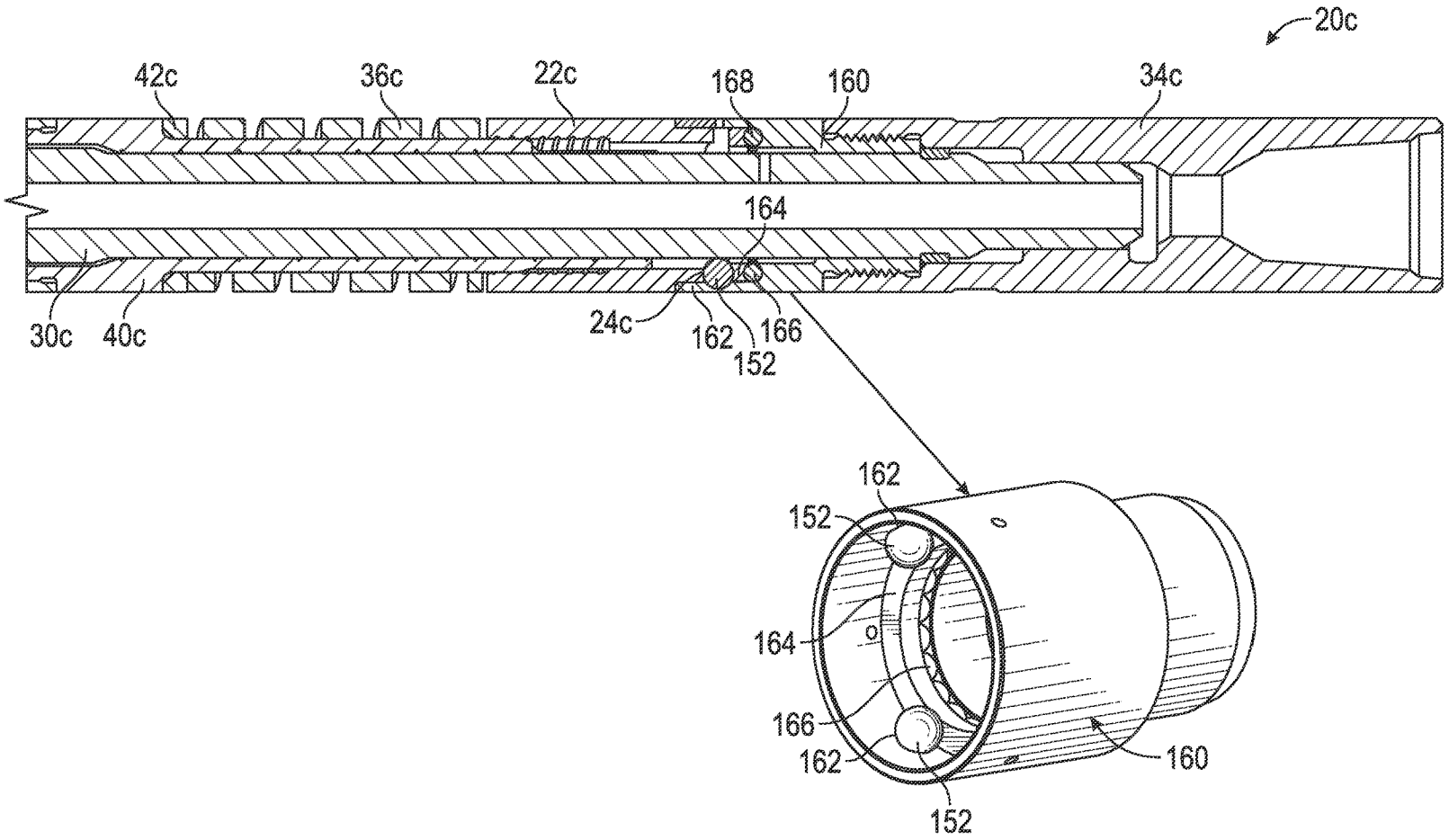
FIG. 12 is a partial sectional view of another alternate embodiment of the lower housing of the downhole apparatus.

FIG. 12 illustrates another alternate embodiment of lower housing 20*c* including anvil sub 160. Anvil sub 160 may be fixedly connected to bitbox sub 34*c*, which is rotationally locked to driveshaft 30*c*. Rolling element 152 may be disposed in partial cavity 162 in an inner wall of anvil sub 160. Anvil sub 160 may include any number of partial cavities 162 for housing rolling elements 152. For example, anvil sub 160 may include three partial cavities 162. Anvil sub 160 may include thrust race 164 adjacent to partial cavities 162 and rolling elements 152. A plurality of thrust bearings 166 are disposed between thrust race 164 and radial shoulder 168 of anvil sub 160. Radial shoulder 168 may include a groove configured to retain thrust bearings 166, such as ball bearings. Thrust bearings 166 and thrust race 164 rotate relative to anvil sub 160 as rolling elements 152 roll along the circumference of radial cam surface 24*c*. Thrust bearings 166 and thrust race 164 assist in ensuring that rolling elements 152 roll (as opposed to sliding) over radial cam surface 24*c* of hammermass 22*c*.

Figure 13:
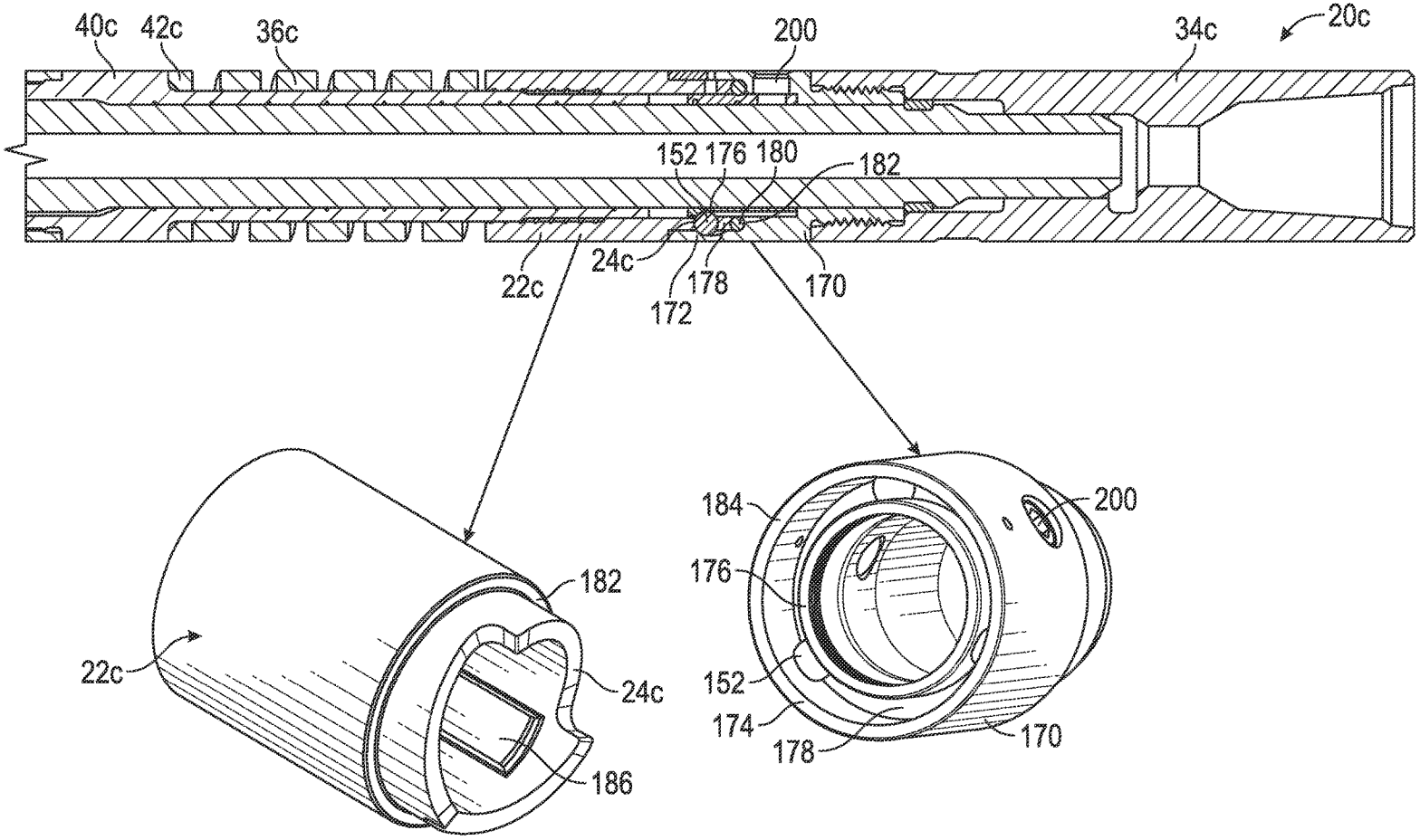
FIG. 13 is a partial sectional view of a further alternate embodiment of the lower housing of the downhole apparatus.

FIG. 13 illustrates a further embodiment of lower housing 20*c* including anvil sub 170. Anvil sub 170 may be fixedly connected to bitbox sub 34*c*, which is rotationally locked to driveshaft 30*c*. Anvil sub 170 may include one or more partial cavities 172 in its inner wall. Inner housing 176 is disposed within anvil sub 170. Inner housing 176 may include a lateral groove dimensioned to retain rolling elements 152 in connection with partial cavities 172 of anvil sub 170. In this way, anvil sub 170 and inner housing 176 may securely retain rolling elements 152. Connecting element 200 locks anvil sub 170 to inner housing 176. Connecting element 200 may include set screws, pins, splines, or keys. Alternatively, instead of partial cavities 172 in anvil sub 170 and inner housing 176, a separate cage member may be placed in anvil sub 170 to retain rolling elements 152. Anvil sub 170 may also include thrust race 178 and a plurality of thrust bearings 180 disposed between thrust race 178 and radial shoulder 182 of anvil sub 170. FIG. 13 shows hammer surface 182 on hammermass 22*c* and anvil surface 184 on anvil sub 170. Hammermass 22*c* also includes splines 186 that cooperate with splines on spring saddle 40*c* to allow hammermass 22*c* to move axially while preventing hammermass 22*c* from rotating relative to spring saddle 40*c*. As anvil sub 150 rotates with the rotation of driveshaft 30*c*, rolling elements 152 roll along radial cam surface 24*c* of hammermass 22*c* thereby creating an axial displacement of hammermass 22*c* relative to anvil sub 150 until rolling elements 152 roll over upstanding portions of radial cam surface 24*c* creating an axial impact by hammer surface 182 impacting anvil surface 184. This arrangement increases the longevity of the apparatus by reducing wear associated with impact forces on rolling elements 152 and radial cam surface 24*c*. This apparatus may include a mechanism for disabling the impacts of hammermass 22*c* to anvil sub 170, such as by disengaging spring 36*c* from hammermass 22*c*, by disengaging splines 186 of hammermass 22*c*, or by locking hammermass 22*c* to anvil sub 170.

Figure 14:
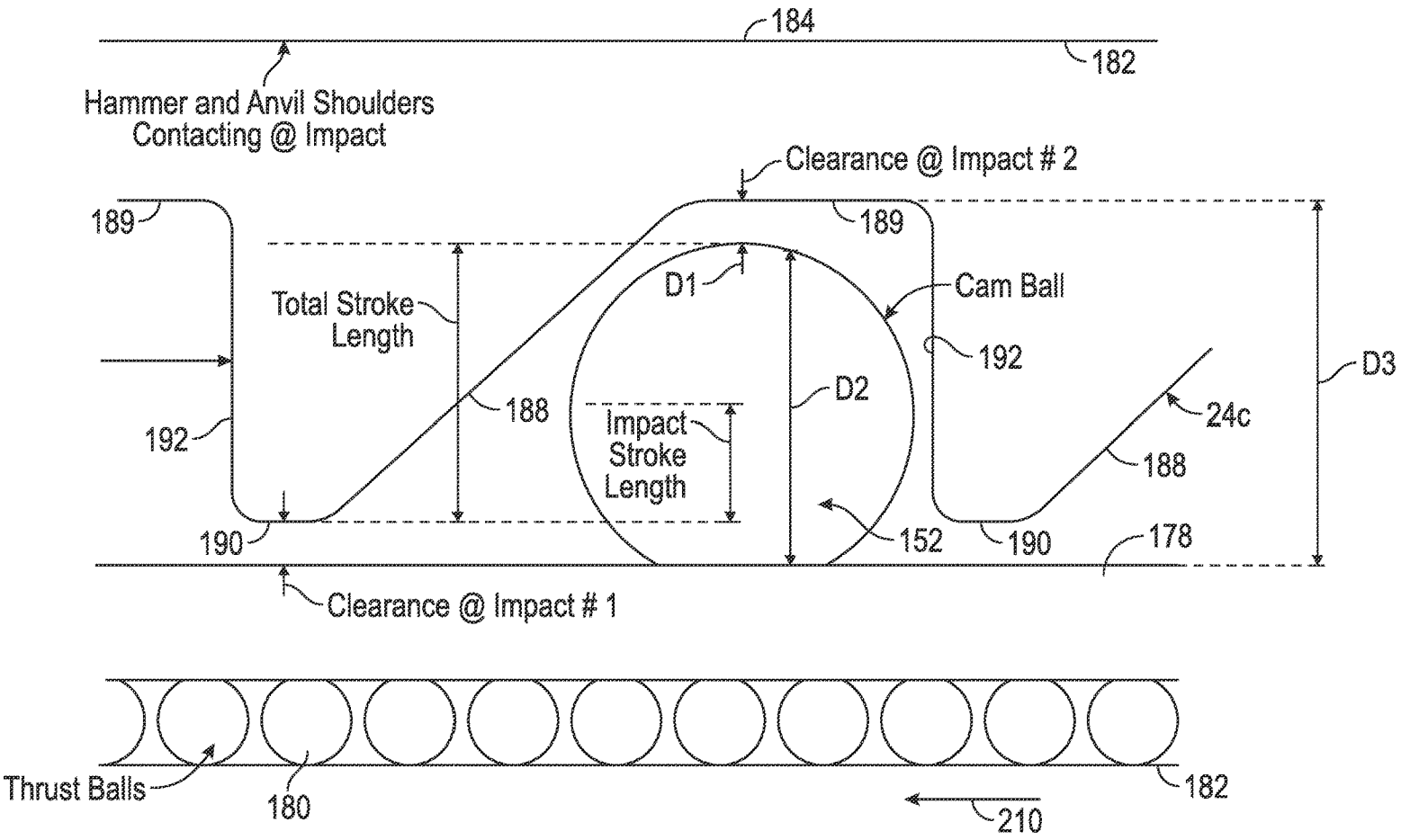
FIG. 14 is a schematic view of the hammermass and anvil sub shown in FIG. 13.

FIG. 14 is a schematic view of the interaction between various components of hammermass 22*c* and anvil sub 170 shown in FIG. 13. Radial cam surface 24*c* of hammermass 22*c* may include ramp portion 188 leading from low point 189 to high point 190, which is adjacent to upstanding portion 192. This profile pattern may repeat along the circumference of radial cam surface 24*c*. As anvil sub 170 rotates with the rotation of driveshaft 30*c*, rolling elements 152 roll along radial cam surface 24*c* of hammermass in direction 210. Specifically, rolling elements 152 may roll along ramp 188 to high point 190. This interaction axially displaces hammer surface 182 of hammermass 22*c* away from anvil surface 184 of anvil sub 170. When rolling elements 152 roll past high point 190, rolling elements 152 may disengage radial cam surface 24*c* and hammermass 22*c* may be forced axially toward anvil sub 170 due to the force of spring 36*c*. Hammer surface 182 impacts anvil surface 184 providing an impact force to the drill bit. FIG. 14 shows the configuration of these components at the moment of impact between hammer surface 182 and anvil surface 184. At the moment of impact, rolling elements 152 may not in contact with radial cam surface 24*c* due to the axial clearance $D_1$ between a diameter $D_2$ of the rolling elements 152 and the distance $D_3$ between thrust race 178 and low point 189 of radial cam surface 24*c*. Axial clearance $D_1$ may further reduce wear on rolling elements 152 and radial cam surface 24*c*. FIG. 14 also shows the total stroke length, i.e., the length of axial displacement of hammermass 22*c* between subsequent impacts. In an alternate embodiment, the rolling elements are housed within the hammermass and the anvil sub includes the radial cam surface.

It will be apparent to one skilled in the art that modifications may be made to the illustrated embodiments without departing from the spirit and scope of the invention. Insofar as the description above and the accompanying drawing disclose any additional subject matter that is not within the scope of the claims below, the inventions are not dedicated to the public and right to file one or more applications to claim such additional inventions is reserved.

We claim:

1. A downhole apparatus connected to a workstring within a wellbore, said workstring being connected to a bit member having a motor means comprising:

a power mandrel operatively connected to the motor means;

an anvil sub including an upper section, a lower section and an internal bore, the upper section having an enlarged outer diameter relative to the outer diameter of the lower section, the upper section of the anvil sub including an outer side wall having an external surface and an internal surface, the internal surface extending from a top anvil surface to a radial shoulder, the internal surface containing a plurality of partial concave-shaped cavities positioned adjacent to the radial shoulder, wherein the lower section of the anvil sub is operatively connected to the bit member, wherein the power mandrel extends through the internal bore of the anvil sub and is operatively connected to the bit member;

a plurality of rolling elements, each of the rolling elements partially disposed within one of the partial cavities of the anvil sub;

a radial bearing housing unit operatively connected to the workstring, the radial bearing housing unit being disposed about the power mandrel;

a spring saddle operatively attached to the radial bearing housing unit;

a spring spacer disposed about the spring saddle;

a spring having a first end and a second end, the first end abutting the spring saddle;

a hammer member slidably attached to the spring saddle and abutting the second end of the spring, the hammer member including a top section and a bottom section, the top section having an outer diameter larger than an outer diameter of the bottom section, the top section terminating at an outer hammer surface and the bottom section extending from the hammer surface and terminating at a radial cam surface, the radial cam surface disposed within the upper section of the anvil sub and positioned adjacent to the internal surface of the outer side wall, the radial cam surface of the hammer member cooperating with the rolling elements disposed in the anvil sub for axially displacing the hammer member from the anvil sub and generating an axial impact upon rotation of the anvil sub.

2. The apparatus of claim 1, wherein the hammer member and the anvil sub are below the radial bearing housing unit.

3. The apparatus of claim 2, wherein the workstring is a tubular drill string or a coiled tubing string.

4. The apparatus of claim 1, wherein the hammer surface contacts the top anvil surface to generate the axial impact upon rotation of the anvil sub.

5. The apparatus of claim 1, further comprising a thrust race and a plurality of thrust bearings disposed within the anvil sub, wherein the plurality of thrust bearings are disposed between the radial shoulder and the thrust race, wherein the thrust race is in contact with the rolling elements, and wherein the thrust race rotates relative to the anvil sub as the rolling elements engage the radial cam surface of the hammer member.

6. The apparatus of claim 5, further comprising an internal housing disposed within the anvil sub, said internal housing including a partial cavity dimensioned to partially house one of the rolling elements so that the rolling element is retained between the inner wall of the anvil sub and the internal housing, and wherein the radial cam surface of the hammer member is disposed between the inner wall and the internal housing of the anvil sub.

7. A method for drilling a wellbore with a workstring, comprising:

a) providing a downhole apparatus connected to the workstring within the wellbore, the downhole apparatus being connected to a bit member and comprising: a power mandrel operatively connected to a motor means; an anvil member with a radial cam surface operatively formed on the bit member, said anvil sub including an upper section, a lower section and an internal bore, the upper section having an enlarged outer diameter relative to the outer diameter of the lower section, the upper section of the anvil sub including an outer side wall having an external surface and an internal surface, the internal surface extending from a top anvil surface to a radial shoulder, the internal surface containing a plurality of partial concave-shaped cavities positioned adjacent to the radial shoulder, wherein the lower section of the anvil sub is operatively connected to the bit member, wherein the power mandrel extends through the internal bore of the anvil sub and is operatively connected to the bit member; a plurality of rolling elements, each of the rolling elements partially disposed within one of the partial cavities of the anvil sub; a radial bearing housing unit operatively connected to the workstring, the radial bearing housing unit being disposed about the power mandrel; a spring saddle operatively attached to the radial bearing housing unit; a spring spacer disposed about the spring saddle, a spring having a first end and a second end, the first end of the spring abutting the spring saddle; a hammer member slidably attached to the spring saddle and abutting the second end of the spring, the hammer member including a top section and a bottom section, the top section having an outer diameter larger than an outer diameter of the bottom section, the top section terminating at an outer hammer surface and the bottom section extending from the hammer surface and terminating at a radial cam surface, the radial cam surface disposed within the upper section of the anvil sub and positioned adjacent to the internal surface of the outer side wall, the radial cam surface of the hammer member cooperating with the rolling elements disposed in the anvil sub for axially displacing the hammer member from the anvil sub and generating an axial impact upon rotation of the anvil sub;

b) lowering the workstring into the wellbore;

c) contacting the bit member with a reservoir interface;

d) engaging a distal end of the power mandrel with a surface of the bit member;

e) slidably moving the anvil sub;

f) engaging the radial cam surface of the hammer member with the rolling elements disposed in the anvil sub to axially displace the hammer member from the anvil sub and to generate an axial impact upon rotation of the anvil sub, thereby imparting an impact force on the bit member.

8. The method of claim 7, wherein the method further provides that static weight on the bit member is transmitted to the bit member different than the impact force created by the hammer member and anvil sub whereby the maximum force on the bit member is the sum of the static weight on bit member and the impact force created by the hammer member and the anvil sub.

9. The method of claim 7, wherein the method further provides that independent of the amount of weight on the bit an oscillating impact force will be generated if the radial cam surface of the hammer member and the rolling elements disposed in the anvil sub are engaging each other.

10. The method of claim 7, wherein the method further provides that the impact force is transmitted through the hammer surface and the top anvil surface.

11. The method of claim 7, wherein the motor means is simultaneously rotationally driving the bit member and axially driving the hammer member.

12. The method of claim 7, wherein there is no axial movement of the radial bearing housing unit relative to the power mandrel that is rotationally driving the bit member and axially driving the hammer member.

* * * * *